United States Patent [19]

Zylla

[11] 4,161,735

[45] Jul. 17, 1979

[54] DETACHABLE ANTENNA MOUNT

[76] Inventor: Norbert R. Zylla, 15253 Yakima St. NW., Anoka, Minn. 55305

[21] Appl. No.: 908,126

[22] Filed: May 22, 1978

[51] Int. Cl.[2] ..... H01Q 1/32

[52] U.S. Cl. ..... 343/713; 343/715

[58] Field of Search ..... 343/711, 713, 715

[56] References Cited

U.S. PATENT DOCUMENTS

| | | | |
|---|---|---|---|
| 3,710,339 | 1/1973 | Rima | 343/715 |
| 3,899,148 | 8/1975 | Fleming | 343/715 |
| 3,967,275 | 6/1976 | Wagman | 343/713 |

*Primary Examiner*—Alfred E. Smith
*Assistant Examiner*—Harry E. Barlow
*Attorney, Agent, or Firm*—Kinney, Lange, Westman & Fairbairn

[57] ABSTRACT

An antenna mount for an antenna, such as the antenna of a citizen band (CB) radio, is adapted to be rapidly clamped to an outwardly extending member such as a rear view mirror support bar of a truck. The mount includes first and second metal plates having clamping portions for holding the support bar therebetween. The first and second plates are connected together at one end by a hinge, and the clamping screw is used for clamping the first and second plates together. The antenna and an antenna connection cable are connected together at a receiving portion or aperture of the first plate so that the ground conductor of the cable is in electrical contact with the first plate. An electrically conductive member is connected to one of the plates and engages the support bar when the plates are clamped together. The antenna mount, therefore, provides an electrical ground connection between the electrical ground conductor of the cable and the metal of the support bar through the pointed member and at least the first plate.

11 Claims, 5 Drawing Figures

DETACHABLE ANTENNA MOUNT

BACKGROUND OF THE INVENTION

The present invention relates to apparatus for mounting antennas on vehicles. In particular, the present invention is a rapidly attachable and detachable antenna mount for mounting a radio antenna on a vehicle such as a truck.

With the growing popularity of citizen band (CB) radios, more and more professional truck drivers (as well as other drivers in general) are buying and utilizing CB radios. The CB radios permit the drivers to keep in communication with their home offices and their dispatchers, as well as to inform each other of road hazards, traffic jams, and the like.

Although some truck drivers own their trucks and can leave their CB radio and antennas permanently mounted, most truck drivers work for others and change from one truck to another very frequently. It is common, therefore, for the truck drivers to own their own CB radios and to take their radios with them as they change from truck to truck. In addition, due to the popularity of CB radio equipment, a large number of CB radios and antennas are stolen. While the radio itself can be locked in the cab of a truck, the antenna is exposed and can be easily stolen. It is advantageous, therefore, to remove the antenna each time the vehicle is left unattended, unless the antenna is permanently attached to the vehicle.

In the past, there have been various types of clamping arrangements which have been used to mount the antennas of CB radios at various locations upon a truck cab. One particularly common technique is to attach the antenna to the rear-view mirror support bar of the truck.

U.S. Pat. No. 3,899,148 by Fleming shows an example of one make-shift arrangement which has been used to mount an antenna to the rear-view mirror support bar. In this type of arrangement, a pair of "vise grip" pliers clamp the antenna support bracket to the mirror support bar. While this permits easy attachment and removal of the antenna, it has several disadvantages. First, vise grip pliers are rather expensive to be used simply for clamping an antenna mounting bracket to a truck. Second, unless great care is used, the vise grip pliers can easily crush the mirror support bar if improperly adjusted. Third, the arrangement is rather unsightly. Fourth, it is difficult if not impossible for the driver to conveniently tilt the antenna when approaching a bridge or obstruction, since the vise grip pliers securely grasp the support bar.

U.S. Pat. No. 3,967,275 by Wagman illustrates another type of antenna mount which may be used. The disadvantage to this arrangement is that it requires Allen wrenches to connect and disconnect the clamping members, and also requires a separate ground wire for grounding the antenna.

SUMMARY OF THE INVENTION

The present invention is a detachable antenna mount which can be rapidly attached or detached from a projecting metal member on a vehicle. The mount includes first and second plates, hinge means, and an electrically conductive pointed member.

The first and second plates have clamping portions for holding the projecting member therebetween. At least the first plate is of an electrically conductive material and has a receiving portion at which the antenna and antenna connection cable may be connected together. The electrical ground conductor of the antenna connection cable is in electrical contact with the electrically conductive first plate when the antenna and antenna connection cable are connected together.

The hinge means connects the first and second plate together at one end, and the clamping screw means clamps the first and second plates together. The hinge means and clamping screw means, therefore, permit rapid clamping and unclamping of the first and second plates around the projecting member, thereby permitting rapid attachment or detachment of the antenna mount from the projecting member.

The electrically conductive pointed member is connected to one of the plates and engages the projecting member when the plates are clamped together. The purpose of this electrically conductive pointed member is to provide an electrical connection between the plates and the metal of the projecting member, so that a reliable electrical ground connection is created between the electrical ground conductor of the cable and the metal of the projecting member.

DETAILED DESCRIPTION OF THE PREFERRED EMBODIMENTS

Figure 1:
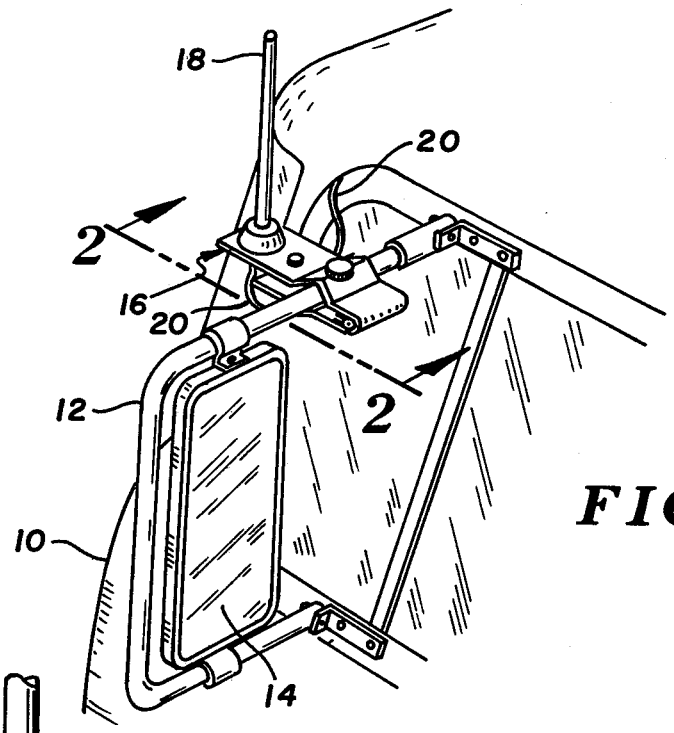
FIG. 1 is a perspective view illustrating a portion of a truck cab with the antenna mounting bracket of the present invention attached to the support rod of a rear-view mirror.

In FIG. 1, a portion of a truck cab 10 is shown. Attached to truck cab 10 is mirror support rod 12, which supports rear-view mirror 14. The antenna mount 16 of the present invention supports CB radio antenna 18, which is mounted at one end of antenna mount 16. Antenna connection cable 20 is connected to antenna 18 at the one end of antenna mount 16, and extends into the cab 10 through a window or door.

Figure 2:
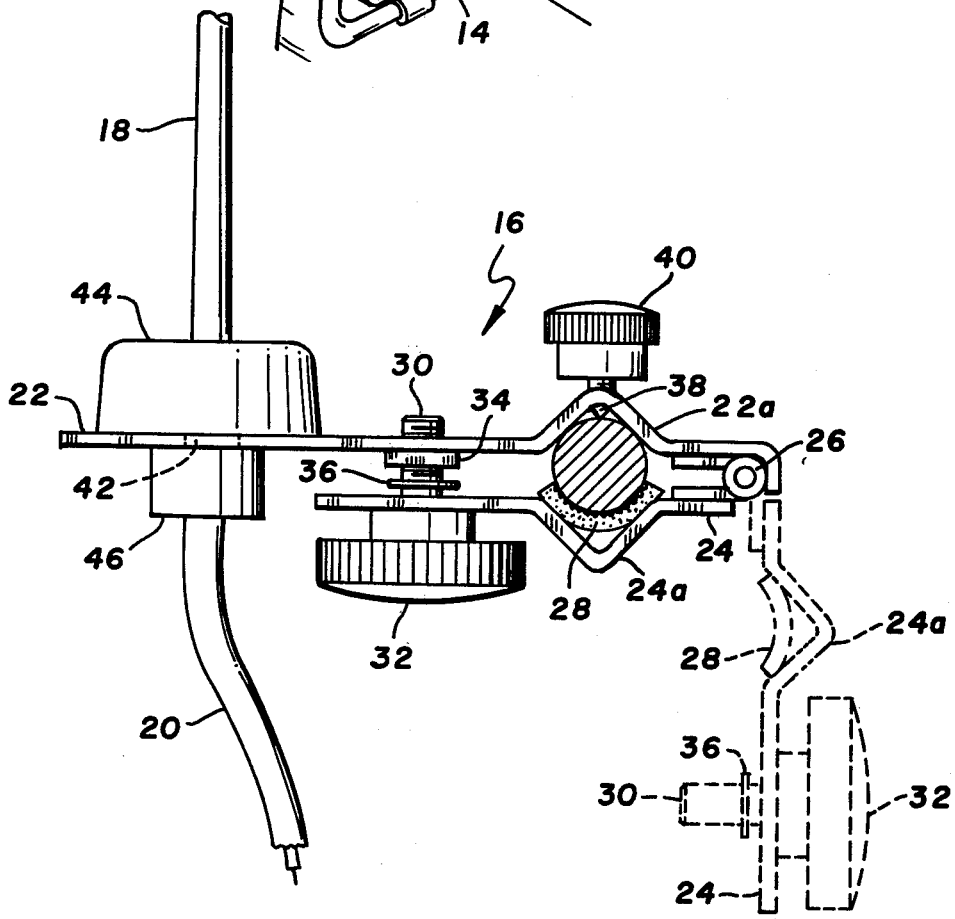
FIG. 2 is a side view of a preferred embodiment of the antenna mount taken along section 2—2 of FIG. 1, with the two plates shown in a clamped and unclamped position.
Figure 3:
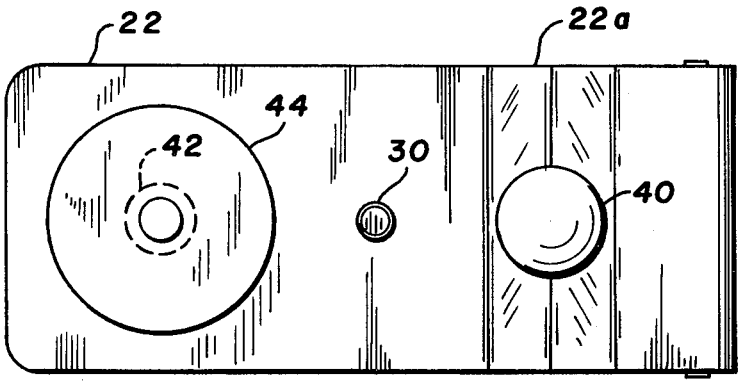
FIG. 3 is a top view of the antenna mount of FIG. 2.
Figure 4:
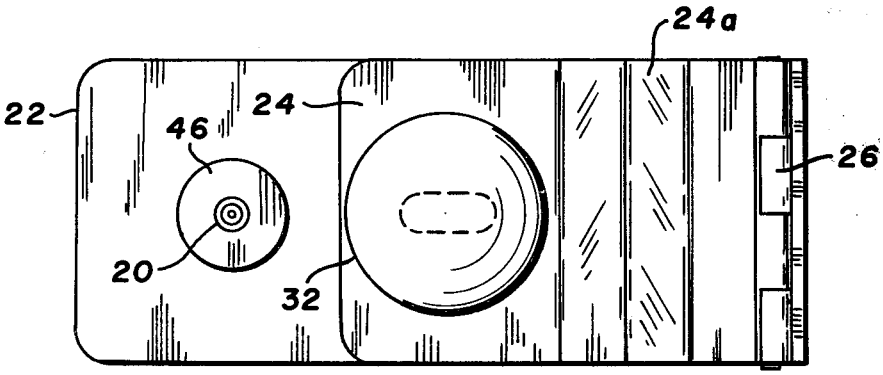
FIG. 4 is a bottom view of the antenna mount of FIG. 2.

FIGS. 2–4 illustrate the antenna mount 16 in further detail. Antenna mount 16 includes a first metal plate 22 and a second metal plate 24 which are hinged together at one end by hinge 26. Plates 22 and 24 have clamping portions **22*a* and 24*a*, respectively. A pad 28 or resilient gripping material is preferably glued to clamping portion 24*a* and includes gripping teeth on its rod engaging side. Clamping portions 22*a* and 24*a*, and particularly pad 28, engage and hold support rod 12** when the antenna mount is in its clamping position.

First and second plates 22 and 24 are clamped together by clamping screw 30, which has a first knurled knob 32 attached at one end. Clamping screw 30 extends through a hole in second plate 24 and is threaded through weld nut 34, which is secured to the underside of plate 22. As shown in FIG. 2, retaining ring 36 on clamping screw 30 prevents clamping screw 30 from falling out of the antenna mount when the antenna mount is in a non-clamping position (as shown in phantom in FIG. 2).

Threadedly engaged with clamping portion 22a is a pointed, electrically conductive screw 38 which has a second knurled knob 40. Pointed screw 38 extends through a threaded hole in clamping portion 22a and has a pointed end which engages rod 12. The purpose of the pointed end of screw 38 is to cut through the paint or enamel on rod 12 to ensure a good ground connection between plate 22 and the metal of rod 12.

Antenna 18 and antenna connecting cable 20 are connected through aperture 42, which is located at one end of first plate 22. As shown in the Figures, first plate 22 includes a portion which extends beyond the end of second plate 24, and it is in this portion that aperture 42 is located. As a result, antenna 18 and cable 20 may be connected to first plate 22 without any interference from second plate 24.

Mounting connectors 44 and 46 physically mount the ends of antenna 18 and cable 20 to first plate 22 at aperture 42. Antenna connection cable 20 is typically a coaxial cable with an inner and an outer conductor (not shown). Mounting connectors 44 and 46 electrically connect the inner conductor of the coaxial cable to antenna 18, while electrically insulating both the inner conductor and antenna 18 from first plate 22. The outer conductor of cable 20 is the ground conductor, and is electrically connected to a conductive portion of mounting connector 46 which is in physical and electrical contact with first plate 22.

Mounting connectors 44 and 46 may take any one of several well known and commercially available forms. For that reason, they are not shown in detail in FIG. 2. They may be either removably or permanently affixed to plate 22. The important features are that they electrically connect the inner conductor of cable 20 to antenna 18 while electrically insulating them from plate 22, and that they provide an electrical connection of the outer conductor of cable 20 to plate 22.

The antenna mount of the present invention, therefore, provides an electrical ground connection between the outer conductor of cable 20 and the truck cab. This electrical ground connection is provided through mounting connector 46, which is in electrical and physical contact with first plate 22. Pointed screw 38 provides a reliable and consistent electrical ground connection between plate 22 and the metal of rod 12. Since rod 12 is bolted to the truck cab 10, electrical contact through pointed member 38 to the metal of rod 12 provides the electrical ground connection to the truck cab.

When the antenna and the antenna mount are in use, antenna 18 and cable 20 are connected to plate 22 of mount 16. When the driver wishes to detach the antenna 18, he merely releases clamping nut 32, and plate 24 swings away from rod 12. The two plates 22 and 24 are now separated at one end from one another and may be removed from around rod 12. This clearly can be accomplished very rapidly, and without any screw driver, pliers, or wrenches.

To install the antenna and antenna mount again, the driver merely slips plates 22 and 24 over rod 12 until the clamping portions 22a and 24a are aligned with rod 12, and then swings plate 24 into position and tightens clamping screw 30 by turning knob 32. To ensure that a proper ground connection is being made, the driver then tightens pointed screw 38 by turning knob 40 until the point penetrates any coating on rod 12.

Figure 5:
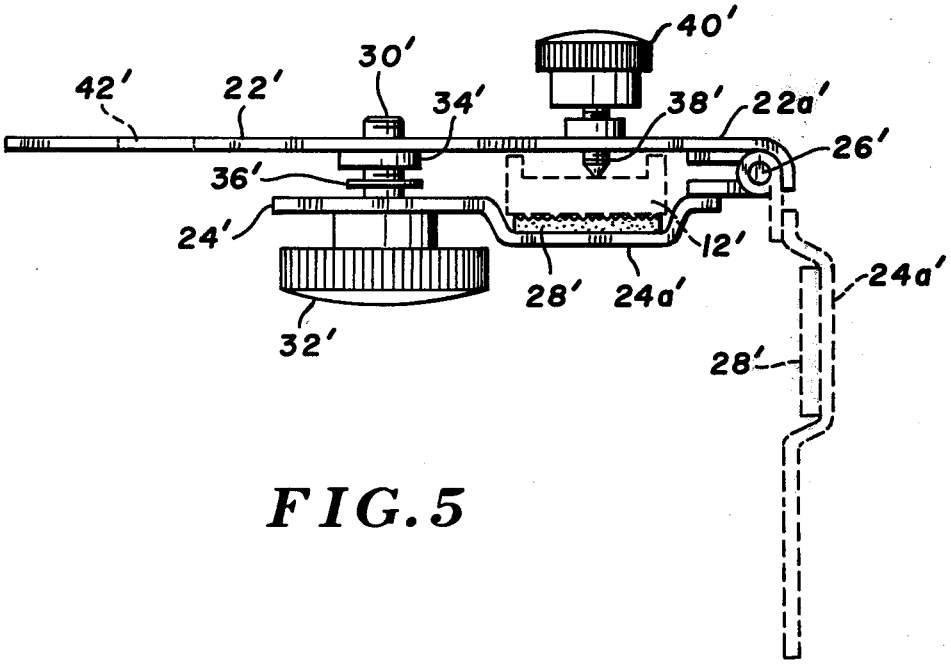
FIG. 5 shows an alternative embodiment of the antenna mount of the present invention which is used for mounting an antenna to a bar rather than a rod type rear-view mirror support.

FIG. 5 illustrates an alternative embodiment of the present invention which is used when the support for the rear-view mirror 14 is in the form of a bar member 12' rather than a cylindrical rod 12 as illustrated in FIGS. 1 and 2. As shown in FIG. 5, the antenna mount is generally similar to that shown in FIGS. 1–4 and similar numerals have been used to designate similar elements, except that a prime (') designation is added. The primary difference between the mounts of FIGS. 1–4 and FIG. 5 is in the shape of the clamping portions of first and second plates 22' and 24'. As shown in FIG. 5, the clamping portion 24a' is rectangular rather than triangular in shape and the clamping portion 22a' is not indented at all. This is possible because of the generally rectangular cross-section of support member 12'.

It can be seen that the antenna mount of the present invention has many significant advantages over the prior art devices. First, because of the one piece hinge construction of the antenna mount of the present invention the driver does not have to keep track of the parts of the antenna mount. Even clamping screw 30 is prevented from falling out of the antenna mount assembly by retaining ring 36.

Second, the pointed screw 38, when turned down tight, penetrates the paint layer on the mounting rod or bar and gives the antenna a reliable ground connection. As a result, the need for a separate ground wire (which is normally used when mounting an antenna to a truck cab) is eliminated.

Third, the antenna mount has a positive hold from grip on the mirror support due to the clamping action of plates 22 and 24, and from gripping pad 28. This eliminates the need for using two or more bolts to keep the mount in place.

Fourth, the antenna mount can be easily loosened slightly and tilted, and then retightened with one hand while the driver sits in the cab. When approaching a low bridge or obstruction, the driver can tilt the antenna quickly and easily to keep the antenna from being struck and damaged.

Fifth, the assembly provides very rapid attachment and detachment. No special wrenches or other tools are required to attach or detach the antenna. This makes it easy for the driver to remove the antenna each time he leaves the truck and reduces the risk of theft of the antenna very significantly.

Sixth, due to its easy installation with a single clamping screw 30, the antenna mount can be attached or detached from the mirror support while the driver is sitting in the cab. In inclement weather the driver can attach or detach the antenna without having to leave the cab of the truck.

Seventh, the antenna mount of the present invention will not damage or disfigure the rear-view mirror. This is a significant danger when vise grips are used to mount the antenna. If the vise grips are not properly adjusted, the support rod for the mirror can be easily crushed. The only mark which the antenna mount of the present invention makes on the support is a very minute point at which pointed screw 38 penetrates the paint to contact the metal of the support. This mark is so small and insignificant that it would not normally be noticed.

Eighth, the simple construction of the antenna mount permits it to be manufactured at low cost.

In conclusion, the antenna mount of the present invention is a highly advantageous and practical device. Although the present invention has been described with reference to preferred embodiments, workers skilled in the art will recognize that changes may be made in form and detail without departing from the spirit and scope of the invention.

What is claimed is:

1. A detachable antenna mount for mounting an antenna to a projecting metal member on a vehicle, permitting connection of the antenna to an antenna connection cable, and providing an electrical ground connection for the antenna connection cable, the detachable antenna mount comprising:

first and second plates having clamping portions for holding the projecting member therebetween, at least the first plate being of an electrically conductive material, the first plate further having a receiving portion at which the antenna and antenna connection cable may be connected together with an electrical ground conductor of the antenna connection cable being in electrical contact with the first plate;

hinge means for connecting the first and second plates together at one end;

clamping screw means for clamping the first and second plates together; and an electrically conductive pointed member connected to one of the plates for engaging the projecting member when the plates are clamped together and providing an electrical connection between the plates and the metal of the projecting member; whereby an electrical ground connection between the electrical ground conductor of the cable and the metal of the projecting member is provided by at least the first plate and the pointed member.

2. The detachable antenna mount of claim 1 wherein the receiving portion of the first plate extends beyond the second plate.

3. The detachable antenna mount of claim 2 wherein the receiving portion includes a mounting aperture.

4. The detachable antenna mount of claim 1 and further comprising:

a resilient gripping pad attached to one of the clamping portions for engaging the projecting metal member.

5. The detachable antenna mount of claim 4 wherein the resilient gripping pad has gripping teeth on its surface which engages the projecting metal member.

6. The detachable antenna mount of claim 1 wherein the pointed member comprises a threaded screw with a pointed end and wherein one of the plates has a threaded hole in its clamping portion for receiving the threaded screw.

7. The detachable antenna mount of claim 6 and further comprising a knob attached to the threaded screw at the opposite end of the threaded screw from the pointed end.

8. The detachable antenna mount of claim 1 wherein the clamping portions are generally triangular shaped grooves.

9. The detachable antenna mount of claim 1 wherein the clamping screw means comprises:

a threaded screw;

a knob attached to one end of the threaded screw;

an aperture in one of the plates through which the threaded screw passes; and a threaded receiving portion of the other plate for receiving the threaded screw.

10. The detachable antenna mount of claim 9 wherein the clamping screw means further comprises:

retainer means connected to the threaded screw on the opposite side of the plate containing the aperture from the knob.

11. The detachable antenna mount of claim 10 wherein the aperture is a slot-shaped aperture.

* * * * *